United States Patent [19]

Kadowaki et al.

[11] 4,311,778

[45] Jan. 19, 1982

[54] ELECTROPHOTOGRAPHIC METHOD

[75] Inventors: Hidejiro Kadowaki, Yokohama; Yasuhide Kurosaki, Mitaka; Takao Aoki, Abiko; Naoki Iwami, Tokyo, all of Japan

[73] Assignee: Canon Kabushiki Kaisha, Tokyo, Japan

[21] Appl. No.: 919,508

[22] Filed: Jun. 27, 1978

[30] Foreign Application Priority Data

Jul. 5, 1977 [JP] Japan ..... 52/80104

[51] Int. Cl.[3] ..... G03G 13/22; G03G 13/04

[52] U.S. Cl. ..... 430/54; 430/55; 430/902

[58] Field of Search ..... 96/1 R, 1 C; 430/54, 430/55, 66, 67

[56] References Cited

U.S. PATENT DOCUMENTS 3,873,310 3/1975 Bean ..... 96/1 C 4,052,206 10/1977 Anzai ..... 96/1 R 4,063,945 12/1977 Von Hoene ..... 96/1 R

OTHER PUBLICATIONS

Schaffert, Electrophotography, 1975, p. 76.

Focal Encyclopedia of Photography, 1969, pp. 890–892.

*Primary Examiner*—Roland E. Martin, Jr.

*Assistant Examiner*—John L. Goodrow

*Attorney, Agent, or Firm*—Fitzpatrick, Cella, Harper & Scinto

[57] ABSTRACT

This specification discloses an electrophotographic method and apparatus for forming an electrostatic latent image on a photosensitive medium having a conductive layer, a photoconductive layer and an insulating layer. The method comprises a primary charging step, an image light exposure step, a secondary charging step, a tone regulating step and a whole surface exposure step.

6 Claims, 19 Drawing Figures

FIG. 4A(1)

| FIG.4A(1) | FIG.4A(2) |
|---|---|

FIG.4A(2)
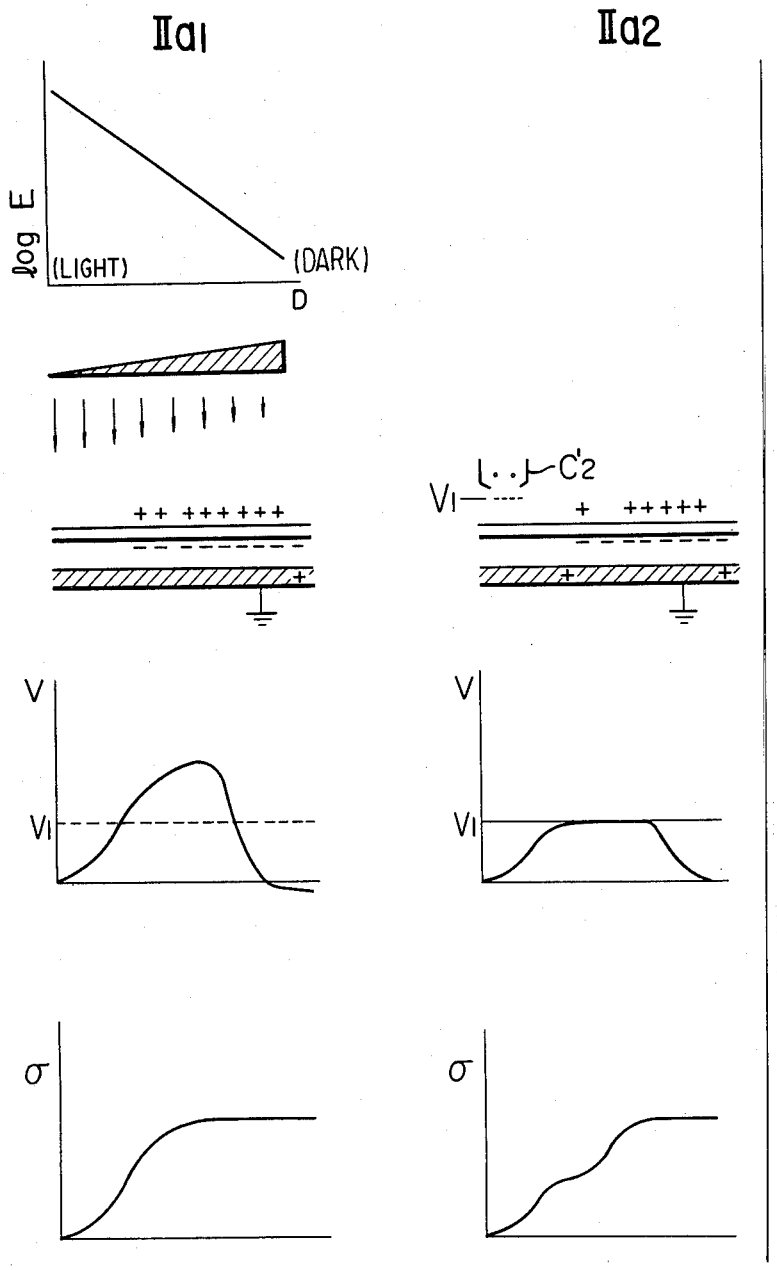

ELECTROPHOTOGRAPHIC METHOD

BACKGROUND OF THE INVENTION

1. Field of the Invention

This invention relates to an electrophotographic method and apparatus, and more particularly to an electrophotographic method and apparatus which enables formation of electrostatic images well representing the tone of original image to be effected on a photosensitive medium having a photoconductive layer.

2. Description of the Prior Art

As the basic electrophotography, there is known the Carlson method disclosed by C. F. Carlson in U.S. Pat. No. 2,297,691. In this method, use is made of an electrophotographic sensitive medium having a photoconductive layer such as amorphous selenium or the like on the surface of a conductive substrate, and the surface thereof is uniformly charged in the dark and then exposed to image original, whereby the surface charge of the photosensitive medium illuminated by light is discharged to thereby form an electrostatic latent image. Such electrostatic latent image is developed by toner particles and then transferred to transfer medium or the like for utilization, as is well-known.

Generally, the range of the brightness reproduction for an original by the above-described Carlson method is of the order of 0.6 to 0.8 and for example, where amorphous selenium is employed, the relation of the latent image potential to the density of the original image is such as shown by full line in FIG. 1 of the accompanying drawings. In fact, the copy density with respect to the original density cannot achieve complete reproduction of density as is shown in FIG. 2 of the accompanying drawings.

After the above-described Carlson method, some types of electrophotography have been proposed which use a photosensitive medium having an insulating layer on a photoconductive layer surface and in which electrostatic image is formed on the photosensitive medium. In one of these types of method, there can be formed electrostatic images which are stable even if exposed to light at a high contrast on the photosensitive medium. Such method is disclosed in detail in U.S. Pat. No. 3,666,363 or U.S. Pat. No. 4,071,361.

Such electrophotography is illustrated in FIG. 3 of the accompanying drawings wherein column I schematically shows the variation in the charge of the photosensitive medium, column II shows the variation in surface potential of the photosensitive medium, and column III shows the variation in the surface charge density of the photosensitive medium.

The photosensitive medium 1 basically comprises a conductive layer 11, a photoconductive layer 12 and an insulating layer 13 (transparent). In the process I, primary charging is effected to uniformly charge the surface of the photosensitive medium by a primary charger C1, to the positive polarity if the photoconductive layer is N-type, and to the negative polarity if the photoconductive layer is P-type. Next, in the process II, the photosensitive medium is exposed to original image whose density is linearly varied and simultaneously therewith, corona charge opposite in polarity to the primary charge or AC corona discharge is imparted by a corona discharger C2 to reduce the surface potential while causing a charge density variation corresponding to the original image. In the process III, the whole surface of the photosensitive medium is uniformly exposed to light to release the charge in the vicinity of the interface between the photoconductive layer and the insulating layer corresponding to the dark region of the original image to thereby effect whole surface exposure representing the surface potential of high contrast. The electrostatic latent image thus formed is subjected to the development, image transfer and fixation as in the above-described method, thereby providing a copy.

The copy formed by the above-described electrophotography has been sufficiently satisfactory for the office purposes. However, the method cannot faithfully reproduce originals containing grey or colors in a wide range for precision printing or artistic printing and so, it has encountered difficulties in obtaining copy images of sufficiently good quality for the precision printing or artistic printing which requires faithful reproduction of the original.

In the conventional electrophotography, light grey on an original image has been reproduced lighter on a copy while dark grey on an original image has been reproduced darker on a copy. Also, in color copying, if it is attempted to reproduce delicate color variations, the resultant copy has become cloudy in color and might have suffered from great color change with respect to the original.

Although these have been improved by improvement of toner characteristic, faithful reproduction of originals are still difficult.

The present invention has been made in view of the above-described points.

SUMMARY OF THE INVENTION

It is an object of the present invention to provide an electrophotographic method and apparatus which is improved in reproduction of color tones.

It is another object of the present invention to provide an electrophotographic method and apparatus in which the range of brightness reproduction is expanded to enable formation of electrostatic image of high contrast faithful to an original.

It is still another object of the present invention to provide an electrophotographic method and apparatus which enables formation of electrostatic image of high contrast at high speed and which is improved in color tone.

The present invention uses a photosensitive medium comprising a conductive layer, a photoconductive layer and an insulating layer and uniformly charges the surface of the photosensitive medium, and then exposes the photosensitive medium to an original image light and subjects the surface of the photosensitive medium to corona discharge having the opposite polarity simultaneously or in succession, and further subjects the photosensitive medium to the original image light whose intensity has been regulated and corona discharge opposite in polarity whose discharging potential has been controlled simultaneously or in succession, and thereafter exposes the whole surface of the photosensitive medium to light, thereby forming an electrostatic latent image on the photosensitive medium.

Other objects and features of the present invention will become apparent from the following detailed description taken in conjunction with the accompanying drawings.

DESCRIPTION OF THE PREFERRED EMBODIMENTS

Figure 4A:
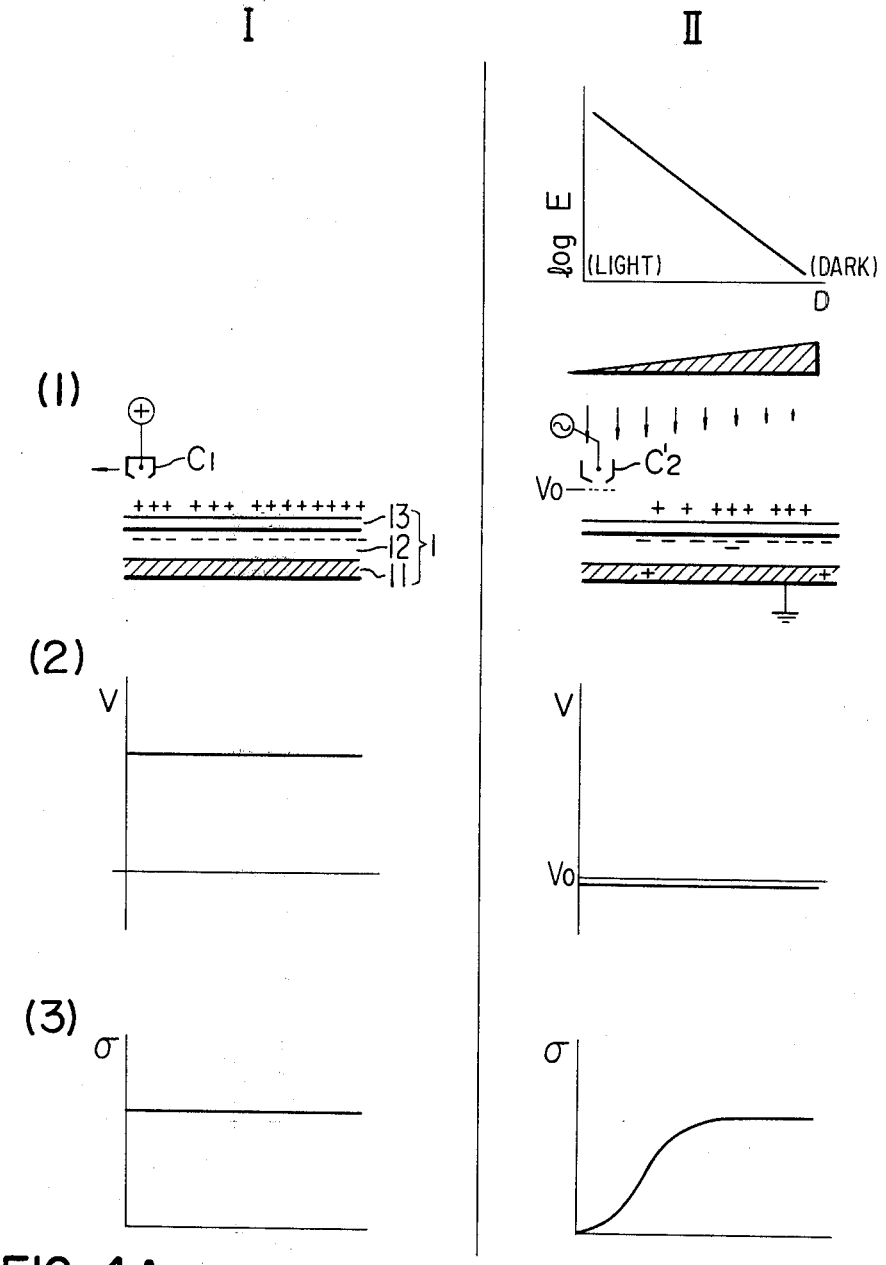
FIGS. 4A and B illustrate the basic construction of the present invention, row (1) schematically illustrating the charge variation of the photosensitive medium, row (2) schematically illustrating the potential difference on the surface of the photosensitive medium, and row (3) schematically illustrating the variation in the charge density of the photosensitive medium surface.
Figure 4B:
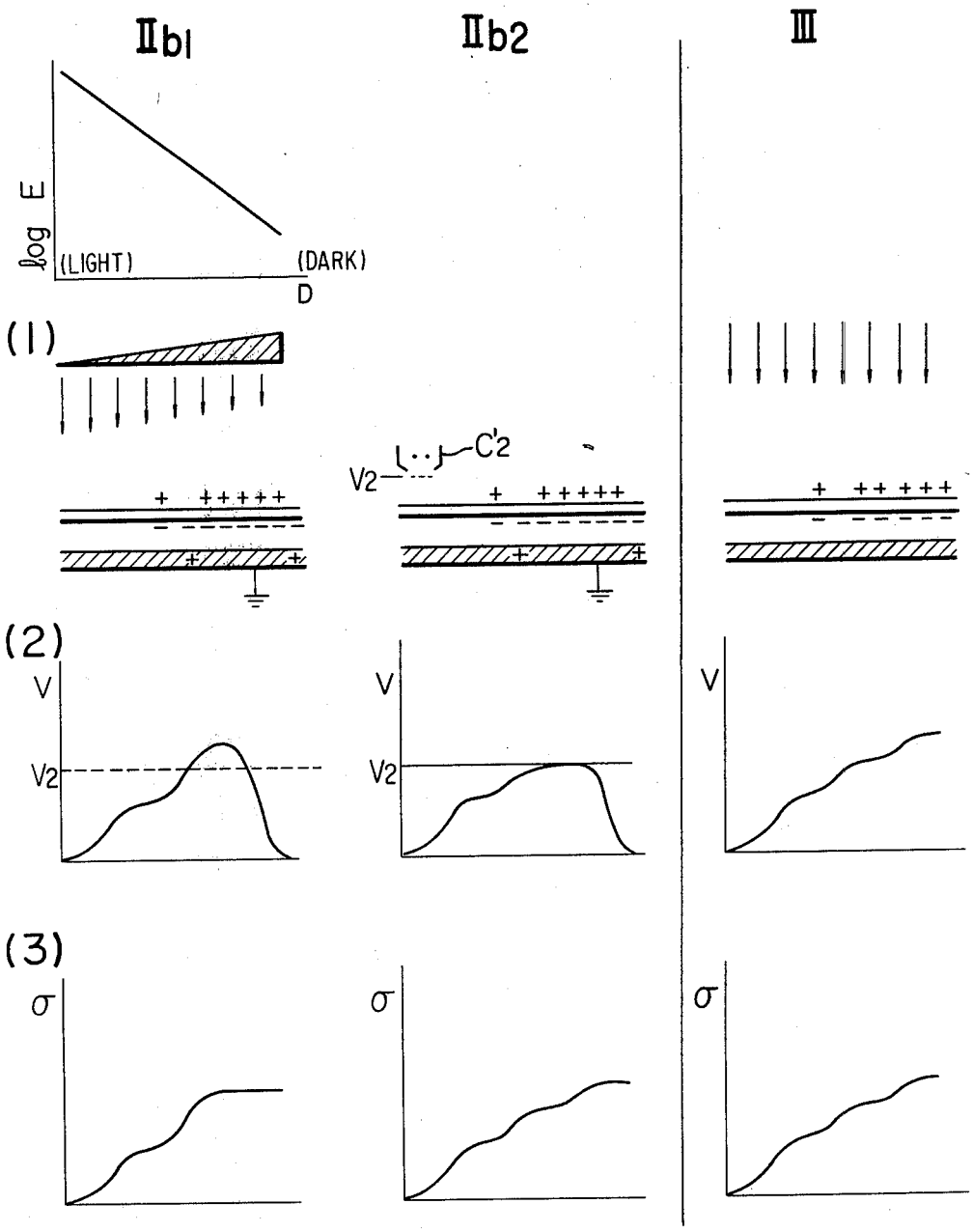

Referring to FIGS. 4A and B, there is shown the basic process of the present invention. In FIG. 4, letters I, II and so on show respective steps of the process. Row (1) of each step schematically illustrates the charged condition of the photosensitive medium. Row (2) of each step shows the surface potential characteristic of the photosensitive medium. Row (3) of each step schematically illustrates the surface charge density characteristic of the photosensitive medium.

Figure 1:
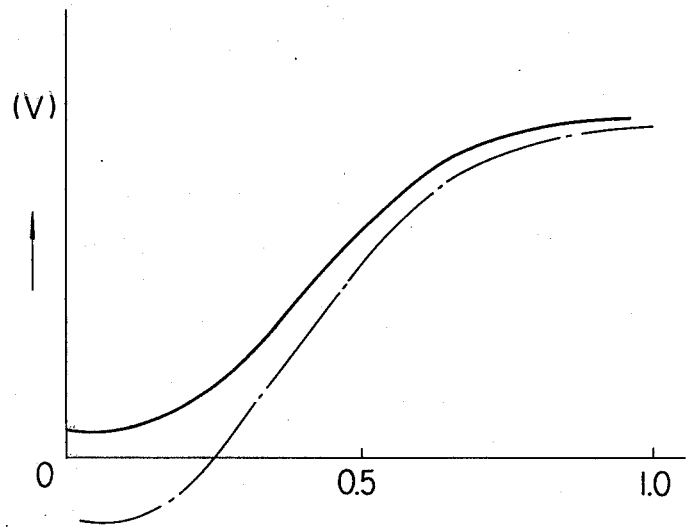
FIG. 1 illustrates the original density-latent image potential characteristic based on the prior art.
Figure 2:
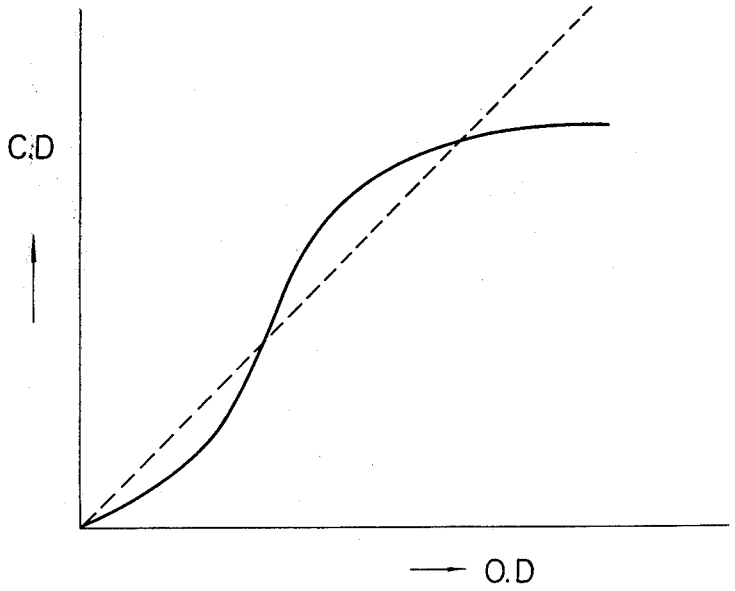
FIG. 2 illustrates the original density-copy density characteristic when the latent image is developed.
Figure 3:
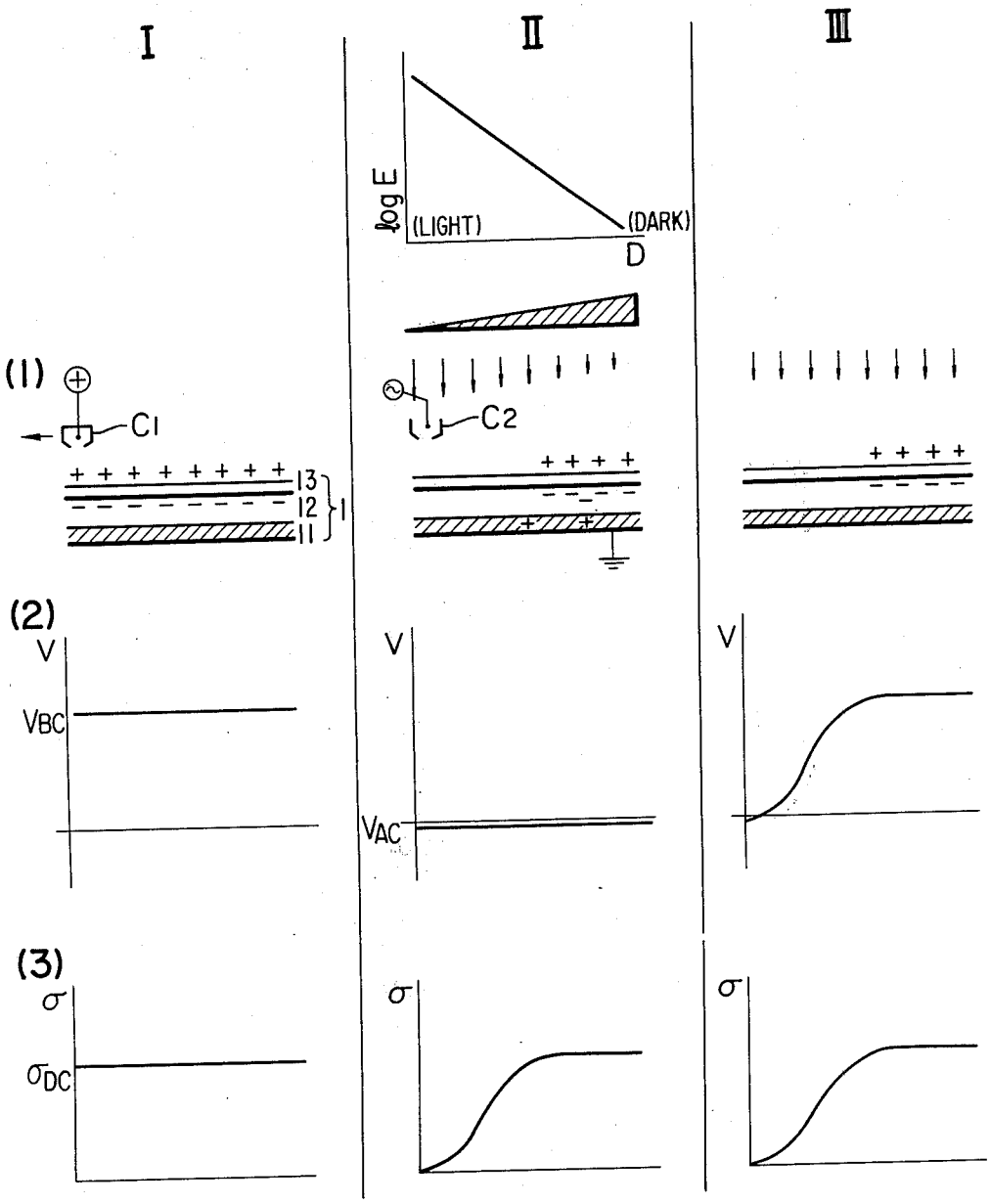
FIG. 3 illustrates the electrophotographic method to be improved by the present invention.

The present invention is an improvement based on the process already described with respect to FIG. 3.

The photosensitive medium used with the present invention has a conductive layer $l_1$, a photoconductive layer $l_2$ and an insulating $l_3$, and may effectively be the photosensitive medium disclosed in detail in the aforementioned U.S. Pat. No. 3,666,363 or U.S. Pat. No. 4,071,361.

In the step I, a photosensitive medium 1 basically comprising conductive substrate 11, a photoconductive layer 12 and an insulating layer 13 is subjected to primary charge by a primary charger C1. The charging polarity is set in accordance with the polarity of the photoconductive layer, but herein the description is made with respect to the case where the photoconductive layer is of N-type. Next, in the step II, the photosensitive medium is subjected to the image light and corona of the opposite polarity to the primary charge or AC corona voltage by corona discharger C2 simultaneously. In this manner, a charge density variation corresponding to the light image is caused on the photosensitive medium. In this state, however, the density variation caused is only the one which enables reproduction of a narrow brightness range. Therefore, according to the present invention, the amount of exposure to the image light and the quantity of discharging potential are controlled to form a good electrostatic latent image. For this purpose, a grid is provided in the opening portion of the aforementioned corona discharger to control the voltage applied thereby. When the discharging in the step II is effected by the corona discharger C2 so provided with the grid, the surface potential $V_0$ is controlled so that it assumes O voltage or some minus voltage after the discharging. Although the charge trapped in the vicinity of the interface between the photoconductive layer and the insulating layer is not released, holes opposite in polarity to the so trapped charge induced in the portion whereat part of the charge has been removed.

Subsequently, there occurs the tone regulating step as described below. In the step II$a_1$, the original image is illuminated, for example, by a more intense light than the light used in the step II, whereby the charge trapped in the light region is released and coupled to the holes in the conductive layer, thus extinguishing. Accordingly, the surface potential on the light region side is varied as shown at II$a_1$-(2). On the other hand, the dark region side, the trapped charge is not released so that no variation occurs to the surface potential. Next, in the step II$a_2$, the surface potential of the photosensitive medium is regulated with the grid potential in the opening portion of the corona discharger C2′ being $V_1$ which is higher than $V_0$, and a discharging voltage is applied to the corona discharger to control the surface of the photosensitive medium approximately to $V_1$.

At this time, the potential exceeding the surface potential $V_1$ which has been varied by the application of image light in the step II$a_1$ is controlled approximately to $V_1$ so that part of the surface charge is removed.

Next, in the step II$b_1$, original image is illuminated by a suitable intensity of light, for example, an intensity of light higher than that of the aforementioned step II$a_1$, and in spite of the fact that the surface charge has been removed, the charge trapped in the vicinity of the interface adjacent to the dark region is released. On the other hand, in the vicinity of the dark region, no light reaches there and therefore, such release of the trapped charge does not take place. Thus, variation in surface charge occurs as shown in the row (2) in column II$b_1$.

Further, in the step II$b_2$, corona discharging is effected while the grid potential of the corona discharge $C_{2'}$ is maintained at $V_2$ which is higher than the aforementioned control voltage $V_1$. By this discharging step, discharge is effected only in the surface potential portion which is substantially higher than $V_2$, and part of the surface charge in that portion is removed. In the step III, the whole surface of the photosensitive medium is uniformly exposed to light to release all of the charge trapped in the interface which is not constrained by the charge on the insulating layer surface. Thereby, it is possible to form on the surface of the photosensitive medium an electrostatic latent image having a surface potential substantially faithful to the density contrast of the original image.

The steps II$a_1$, II$a_2$ and the steps II$b_1$, II$b_2$ may further be followed by repeated exposure and charging steps.

Figure 5A:
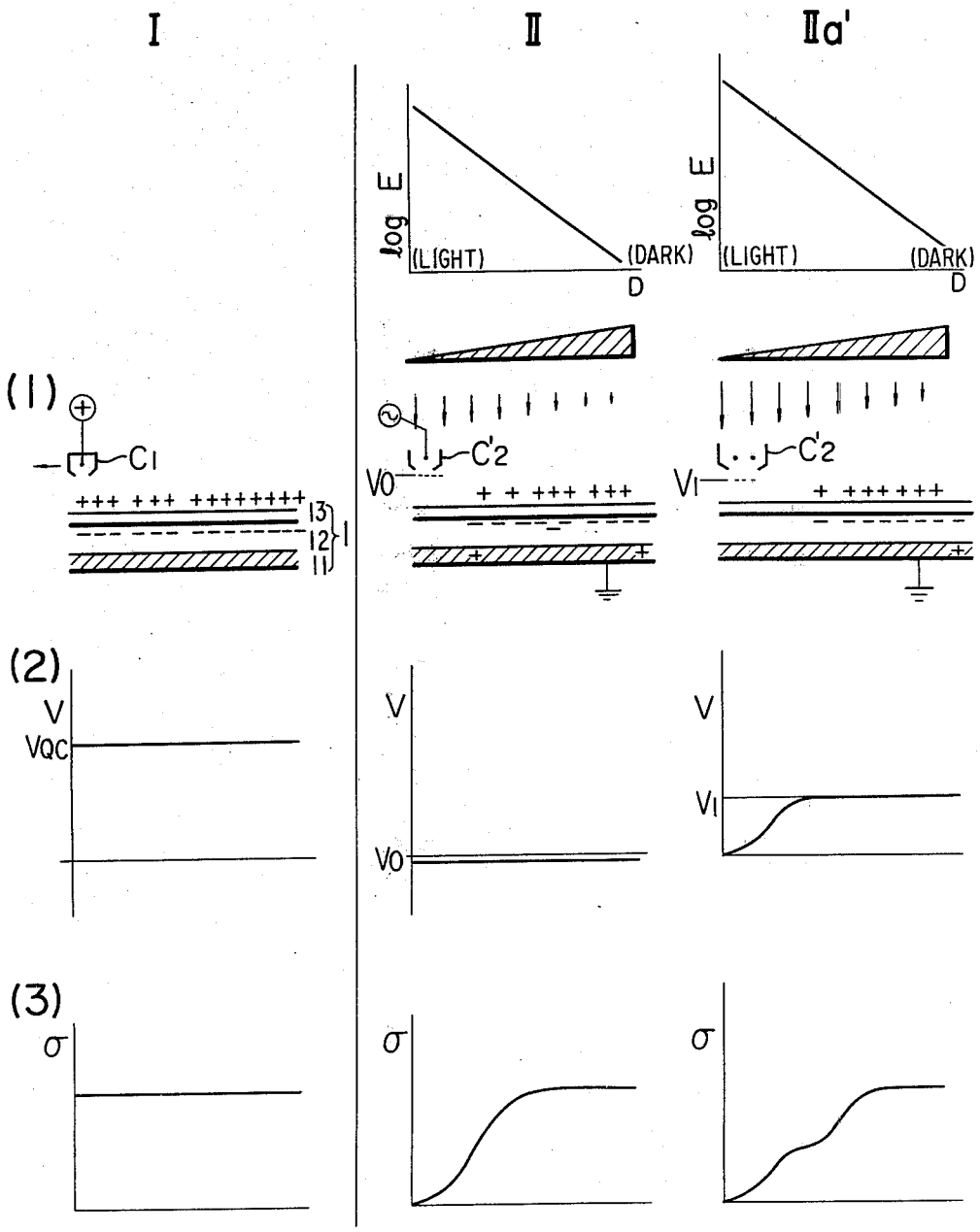
FIGS. 5A and B illustrate the process according to a modification of the present invention, rows (1) to (3) corresponding to those in FIGS. 4A and B.
Figure 5B:
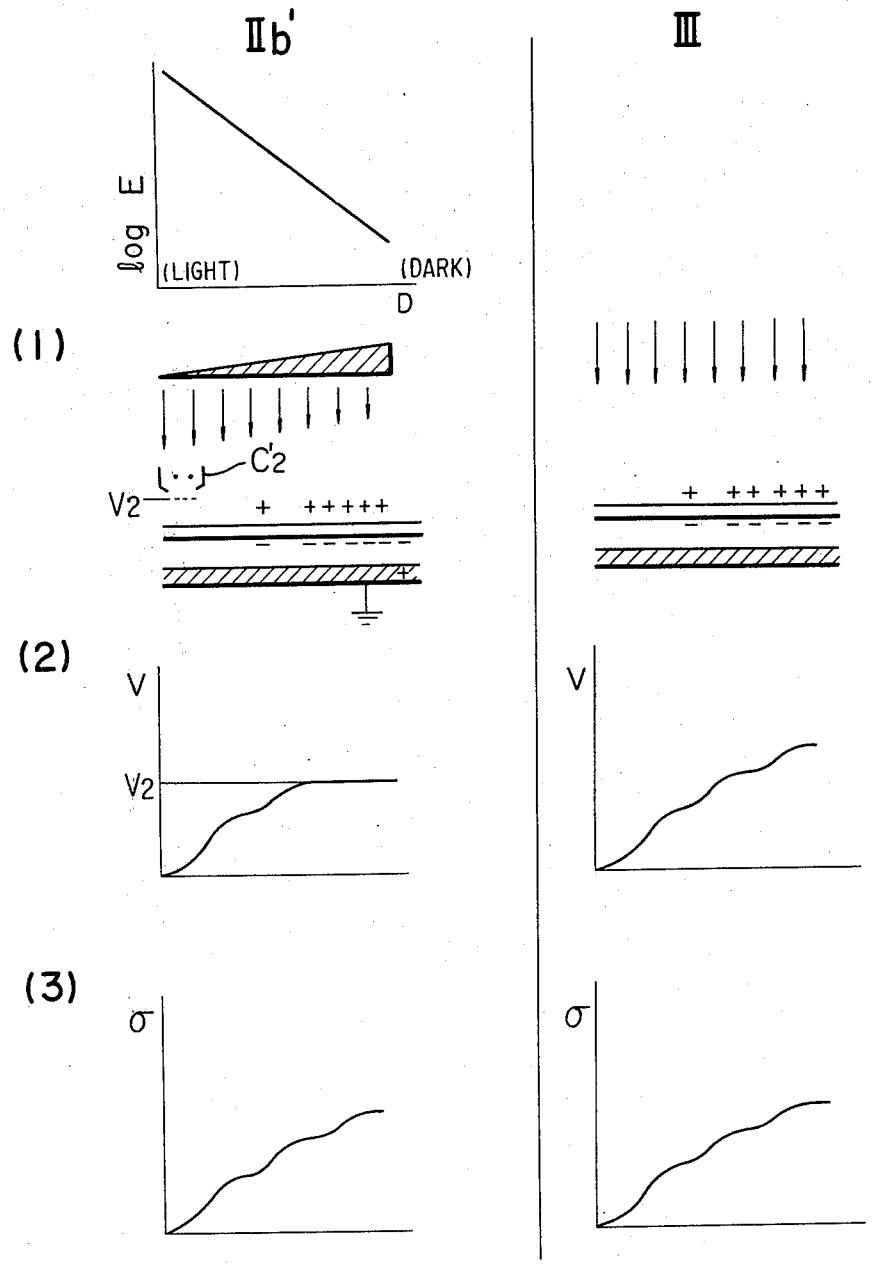

FIGS. 5A and B illustrate the process according to a modification of the present invention. In this modification, the steps II$a_1$ and II$a_2$ in the above-described basic process are carried out in one step II$a'$, and the steps II$b_1$ and II$b_2$ are carried out in one step II$b'$.

More specifically, after the application of image light and simultaneous discharging have been effected on the basis of the same step II as that described above, the light of the original image is projected on the surface of the photosensitive medium as the step II$a'$ by suitably regulating the intensity of the light, for example, to an intensity higher than that used in the step II. Simultaneously with this application of the image light, corona discharge is effected by controlling the discharging potential as the grid potential $V_1$ of the corona discharge C2'. Subsequently, as the step II$b'$, the light of the original image is projected by suitably regulating the intensity of the light, for example, to an intensity higher than that used in the step II$a'$ and simultaneously therewith, corona discharge is effected by controlling the discharging potential as the higher grid potential $V_2$ of the corona discharger C2'. Thereafter, whole surface exposure takes place as the step III, as in the previous example. It is also possible to effect the step II$a$ alone if the tone is low accordance with the quality of the original image. On the other hand, if the original image has a delicate tone, not only the steps II$a'$ and II$b'$ may take place but also similar steps may additionally be repeated. In other words, the exposure to the original image light suitably regulated in intensity and the discharging suitably controlled in discharging potential may be added as one additional step.

As a further modification, it is of course possible to adopt a construction in which the steps II$a_1$, II$a_2$ of the above-described basic process are followed by the step II$a'$ or the step II$b'$ of the above-described modified process or a construction in which the step II$a'$ of the above-described modified process is followed by the steps II$a_1$, II$a_2$ and or the steps II$b_1$, II$b_2$ of the basic process.

Figure 6:
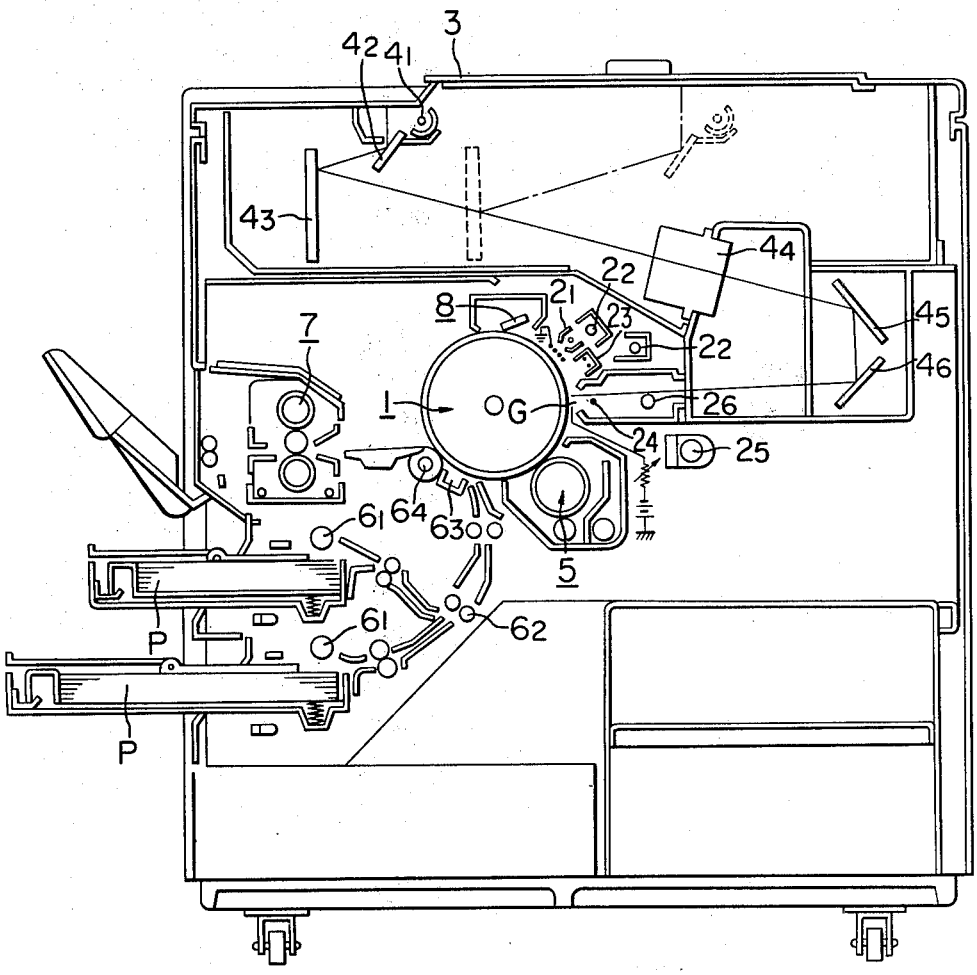
FIG. 6 is a side view illustrating a specific electrophotographic apparatus embodying the process of the present invention.

FIG. 6 is a side view illustrating a specific electrophotographic apparatus which incorporates the process of the present invention. A photosensitive medium 1 basically comprises a conductive substrate 11, a photoconductive layer 12 and an insulating layer 13, and is formed into a rotatable drum. The conductive substrate may be a plate of aluminum or like metal, and the photoconductive layer may be formed of copper having CdS dispersed by a transparent resin binder and having a thickness of about 50$\mu$. A Miler film of about 25$\mu$ is adhesively secured to the surface of the photoconductive layer. Disposed around the drum-shaped photosensitive medium is latent image formation means having an AC discharger 21 and a pre-exposure lamp $2_2$ which erases the history of the photosensitive medium to eliminate irregularity of the image quality which would otherwise occur during continuous copying. The latent image formation means further has a primary charger $2_3$ which uniformly charges the surface of the photosensitive medium 1 to render that surface to a potential of approximately +1500 V. An original whose image is formed on the uniformly charged photosensitive medium is placed on an original carriage 3 and is projected onto the photosensitive medium by original exposure means 4. The original exposure means 4 comprises an illuminating light source 41 for illuminating the original carriage 3, movable mirrors 42 and 43 movable with the illuminating light source and scanning the surface of the original, a lens 44 for focusing the original image, and mirrors 45 and 46 for directing the image light onto the surface of the photosensitive medium. On the light path, a bias light source or infrared bias light source 26 is provided which is effective to expand the range of brightness reproduction.

Further, a corona discharger 24 which is operative simultaneously with the application of image light is provided to form a latent image. The opening portion of the corona discharger is provided with a control grid capable of partly regulating the control voltage, as will further be described, and a predetermined voltage is applied thereto. A potential of the negative polarity is first applied to render the surface potential to about −100 V.

Then, the surface of the photosensitive medium is uniformly exposed to light from a whole surface exposure lamp 25 to provide a high surface potential based on the electrostatic image. Generally, at this time, the potential is −50 to −100 V at the light region and +400 to +600 V at the dark region. Therefore, the electrostatic image contrast is 450 to 700 V.

A sleeve type magnet brush developing device 5 is disposed so as to supply developer to the surface of the photosensitive medium after the formation of the latent image. Since the latent image then formed is controlled so that the light region potential thereof is −50 to −100 V, the phenomenon of fog which is developer deposited on the light region cannot take place by the sleeve of the developing device being maintained at the ground potential.

The developed image on the photosensitive medium is transferred onto a transfer medium P, by means of an image transfer corona discharger $6_3$ forming part of paper feed and transfer means. The transferred image on the transfer medium P is melted and fixed thereon by a heating-fixing device 7, whereafter it is discharged onto a discharge tray T. On the other hand, the developer remaining on the photosensitive medium is removed by cleaning means 8, thus rendering the photosensitive medium ready for another cycle.

Figure 7:
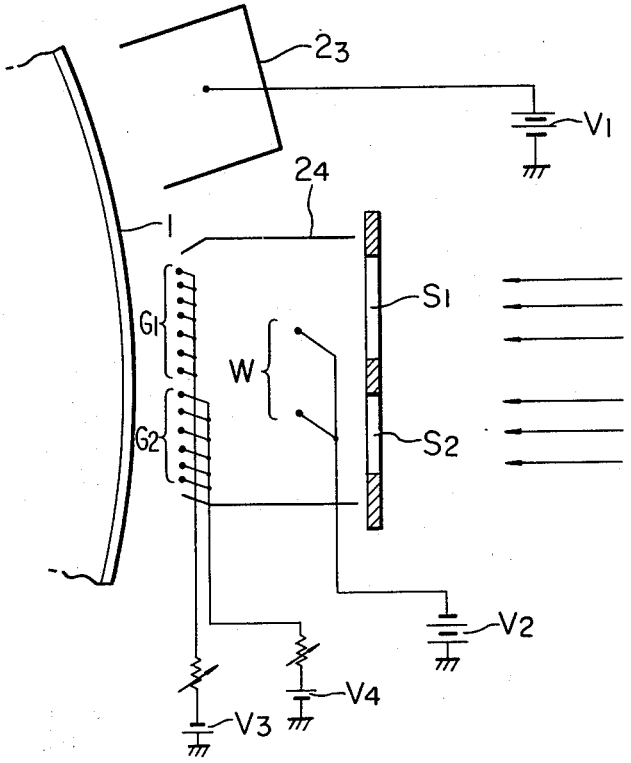
FIG. 7 is an enlarged partial view illustrating electrostatic image formation means.

Description will now be made of the corona discharger used simultaneously with the application of image light. FIG. 7 enlargedly shows a portion of such discharger. The corona discharger comprises a corona discharge wire W and control grid wires G1, G2 stretched parallel to the rotary shaft of the drum and accordingly, perpendicularly to the direction of rotation of the drum. About −100 V is applied to the grid G1 on the primary charger $2_3$ side and about +100 V is applied to the whole surface exposure lamp side. At this time, the photosensitive medium is uniformly charged by the primary charger 23 and exposed to image light and simultaneously therewith, discharged by the corona discharger 24 of the opposite polarity. The discharging is effected by the corona passed through the grid G1 to which, for example, −100 V has been applied as already described, and then by the corona passed through the grid G2 to which, for example, +100 V has been applied. Designated by $V_1$ to $V_4$ are respective voltage sources. Therafter, the whole surface of the photosensitive medium is uniformly illuminated by a lamp 25 to thereby form an electrostatic latent image thereon.

At the back of the optically open corona discharger 24, there are disposed slits S1 and S2 having a predetermined opening width through which the quantity of image light to be projected onto the photosensitive medium through the control grids G1 and G2 of the corona discharger 24 is regulated. Each of these slits may simply be of a construction in which a light-intercepting plate is provided to regulate the gap. Or alternatively, each of the slits may effectively be of a construction in which slits differing in gap width may be replaced by one another. However, the slits are not restricted to these examples but, of course, use may be made of various quantity of light regulating means such as ND filter, light source adjustment, etc.

Figure 8A:
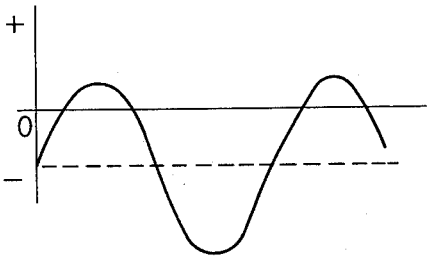
FIGS. 8A and B illustrate the corona discharge current used in the discharging step of the present invention.
Figure 8B:
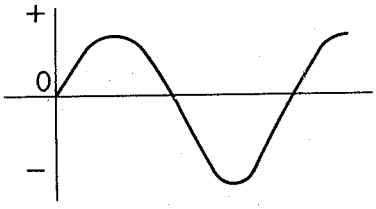
Figure 9:
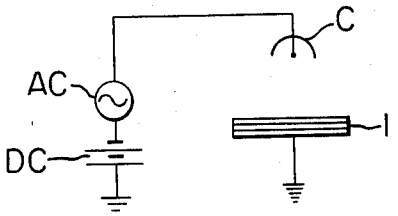
FIG. 9 shows a specific construction for obtaining the corona discharge current of FIG. 8A.
Figure 10A:
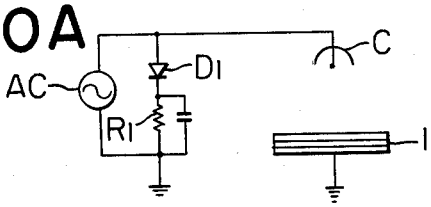
FIGS. 10A and B show a specific construction for obtaining the corona discharge current of FIG. 8B.
Figure 10B:
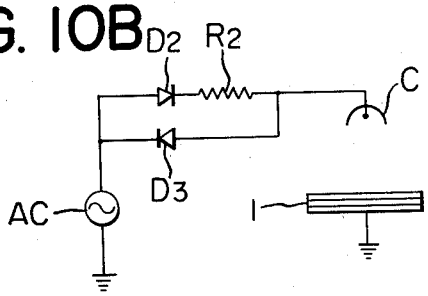

In the above-described embodiment, corona discharge of the opposite polarity with grids provided adjacent to the photosensitive medium has been used for discharging, but other methods are also effective, for example, a method using corona discharge having minus component superposed on AC corona discharge current (See FIG. 8A) or a method using corona discharge having weakened plus component of AC discharge (See FIG. 8B). FIG. 9 shows a specific example of the means for obtaining the corona discharge as shown in FIG. 8A. The case of FIG. 8B is shown in FIGS. 10A and 10B. FIG. 9 is a circuit in which a minus voltage DC(−) is applied to the AC voltage source AC of the corona discharger C. FIG. 10A is a circuit in which a rectifier element D1 is provided in parallelism to the AC voltage source and plus component is shunted by a resistance element R1 series-connected to the rectifier D1.

FIG. 10B shows a circuit in which a set of parallel-connected rectifier elements D1, D2 is series-connected between the AC voltage source AC and the corona discharger C. A resistor element R2 is inserted on the side of one of the rectifier elements D1, D2, namely, on the side of the rectifier D2 which provides the path of the plus component so as to realize the voltage drop of the plus component.

Figure 11A:
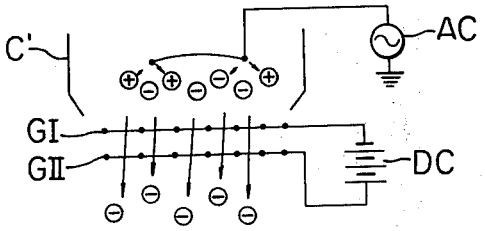
FIGS. 11A and B schematically illustrate a modification of the grid control during discharging.
Figure 11B:
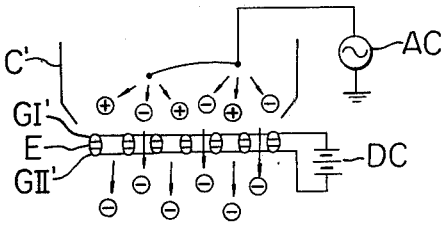

FIGS. 11A and B shows a modification of the grid control for the control of the discharging potential. A control grid as shown is provided in the opening portion of the AC corona discharger C′ to control the corona passing therethrough. In FIG. 11A, a first GI and a second grid GII are disposed parallel to each other. In FIG. 11B, an insulator E is provided between the first and second grids GI′ and GII′. In any of these, the negative pole of the power source DC is connected to the first grids GI and GI′ of the corona discharge side so as to suppress the plus component of the AC corona discharge and take out the negative component alone, and the positive pole of the power source is connected to the second grids GII, GII′ of the opposite side so as to form an electric field in a direction to pass the negative component corona.

Some examples of the present invention will be shown below to make the invention better understood.

EXAMPLE 1

In the apparatus of FIG. 6, the surface of the aforementioned photosensitive medium was rendered to about 1.5 KV by primary charging and, at the corona discharger operative simultaneously with the application of image light, a voltage of −100 V was applied to the control grid G1 and voltage of +100 V was applied to the control grid G2, and a voltage of −8 KV was applied to the corona wire of the corona discharger 24.

The amount of exposure from the control grid G1 portion to the surface of the photosensitive medium was 2.4 lux/sec. and the amount of exposure from the control grid G1 portion was 2.6 lux/sec.

Thereafter, the whole surface of the photosensitive medium was exposed to light to form an electrostatic latent image of high contrast.

Figure 12:
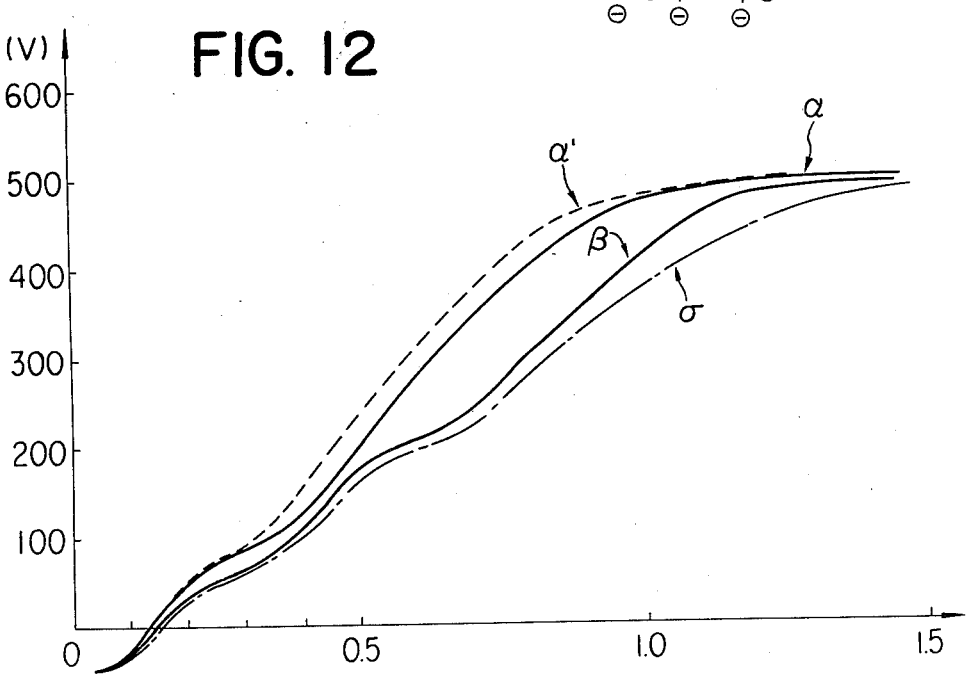
FIG. 12 illustrates the original density-latent image potential characteristic of the electrostatic latent image formed by the embodiment of the present invention.

The then relation of the potential of the electrostatic latent image to the density of the original image is shown by the full line $\alpha$ in FIG. 12.

As will be seen from FIG. 12, the range of brightness reproduction was about 1.0, a great improvement over the prior art in which the range of brightness reproduction was only 0.6 to 0.8.

EXAMPLE 2

As in Example 1, the surface of the photosensitive medium was subjected to the primary charging, and the same voltage as in Example 2 was applied to the corona wire of the corona discharger 24 operative simultaneously with the application of the image light, and the same control grid voltage as in Example 1 was also applied.

The amount of exposure from the control grid G1 portion to the surface of the photosensitive medium was 2.4 lux/sec. and the amount of exposure from the control grid G2 portion was 2.0 lux/sec.

The relation of the electrostatic latent image formed on the surface of the photosensitive medium after whole surface exposure to the density of the original image is shown by dotted line $\alpha'$ in FIG. 12.

EXAMPLE 3

Use was made of a corona discharger provided with three-divided control grids instead of the two-divided control grids of the corona discharger 24. As in the above-described examples, the photosensitive medium after uniformly charged was subjected to image light and discharging simultaneously. During that time, −100 V was applied from the primary charging side to the control grid G1 of the discharger, +50 V was applied to the next control grid G2, and +200 V was applied to the last control grid G3. On the other hand, the amount of exposure to the image light was 4 lux/sec. from the control grid G1 portion, 2.6 lux/sec. from the control grid G2 portion, and 2.6 lux/sec. from the control grid G3 portion.

The relation of the potential of the electrostatic latent image formed on the surface of the photosensitive medium after the whole surface exposure to the density of original image is shown by dot-and-dash line $\beta$ in FIG. 12.

EXAMPLE 4

Under the same conditions as in Example 3, the primary charging, the application of the image light and discharging were carried out and additionally, infrared bias light was used in the application of the image light.

The relation of the potential of the electrostatic latent image formed on the photosensitive medium after the whole surface exposure to the density of the original image is shown by dots-and-dash line $\gamma$ in FIG. 12.

In this case, the range of brightness reproduction was expanded to about 1.4.

As hitherto described specifically, the method of the present invention expands the range of brightness reproduction and enables faithful and good reproduction of color tones of original images.

Moreover, in accordance with the color tones of the original images to be reproduced, the times of exposure and discharging steps may be controlled so as to enable the optimal image reproduction to be realized by an optimal number of steps, and this is highly effective. The control of the color tones can be effected very simply by the control of the discharging potential, which is quite effective in practice.

In addition, the electrostatic latent image formed by the present invention is very stable and this promises very effective utilization of copy images.

What we claim is:

1. A method of electrophotographically forming an electrostatic latent image using a photosensitive member which includes a photoconductive layer and a surface insulating layer comprising:

(a) a primary charging step in which the surface of the photosensitive member is uniformly charged to a first potential;

(b) an imaging step in which the photosensitive member is exposed to a pattern of image light, subsequent to the primary charging step;

(c) a secondary charging step in which the surface of the photosensitive member is subjected to corona discharge having at least a component of opposite polarity to the primary charge, so as to at least reduce the surface potential to a second potential, the secondary charging step being carried out simultaneously with or subsequent to the imaging step;

(d) a tone regulating step in which the photosensitive member is subjected to further image light whose intensity is controlled and in which the surface of the photosensitive member is subjected to a discharging step, wherein the charge trapped in exposed areas is released during the step of applying further image light, thus tending to limit the surface potential to a predetermined level intermediate the levels of said first and second potentials; and (e) a whole surface exposure step in which the photoconductive layer is uniformly activated.

2. A method according to claim 1, wherein said tone regulating step is repeated a plurality of times between said secondary charging step and said whole surface exposure step.

3. A method according to claim 2, wherein the surface of the photosensitive member is subjected to a discharging step which limits the surface potential, after said tone regulating step is repeated, to a level between said first potential and the potential resulting from said first tone regulating step.

4. A method according to claim 1 or 2, wherein the intensity of the image light during the tone regulating step differs from the intensity of the image light during the image light exposure step.

5. A method according to claim 1, wherein the intensity of the image light during the tone regulating step is substantially equal to the intensity of the image light during the image light exposure step.

6. A method according to claim 1, wherein the intensity of the image light during the tone regulating step is greater than the intensity of the image light during the image light exposure step.

* * * * *